US009419377B2

(12) United States Patent
Zhu et al.

(10) Patent No.: US 9,419,377 B2
(45) Date of Patent: Aug. 16, 2016

(54) DUAL ORIENTATION ELECTRICAL CONNECTOR ASSEMBLY

(71) Applicant: FOXCONN INTERCONNECT TECHNOLOGY LIMITED, Grand Cayman (KY)

(72) Inventors: Zhi-Hui Zhu, Kunshan (CN); Wen-Yi Hsieh, New Taipei (TW); Hsueh-Lung Hsiao, New Taipei (TW); Wei-Chung Lin, New Taipei (TW); Xin-Gang Ji, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/600,013

(22) Filed: Jan. 20, 2015

(65) Prior Publication Data

US 2015/0207268 A1 Jul. 23, 2015

(30) Foreign Application Priority Data

Jan. 20, 2014 (CN) ..... 2014 2 0032571 U

(51) Int. Cl.
*H01R 13/60* (2006.01)
*H01R 13/62* (2006.01)
*H01R 13/24* (2006.01)

(52) U.S. Cl.
CPC ..... *H01R 13/6205* (2013.01); *H01R 13/24* (2013.01)

(58) Field of Classification Search
CPC ..... H01R 13/6205; H01R 13/24
USPC ..... 439/38, 39, 40
See application file for complete search history.

(56) References Cited

U.S. PATENT DOCUMENTS

| | | | | |
|---|---|---|---|---|
| 4,726,786 | A * | 2/1988 | Hill | H01R 31/06 439/504 |
| 7,311,526 | B2 | 12/2007 | Rohrbach et al. | |
| 8,920,178 | B2 * | 12/2014 | Wei | G06F 1/1626 361/679.41 |
| 9,017,092 | B1 * | 4/2015 | McCracken | H01R 13/62 439/374 |
| 9,065,205 | B2 * | 6/2015 | Gao | H01R 13/508 |
| 9,112,304 | B2 * | 8/2015 | Rohrbach | H01R 13/6205 |
| 9,118,990 | B2 * | 8/2015 | Hankey | H01R 13/2428 |
| 2006/0114087 | A1 * | 6/2006 | Deng | H01R 13/6205 335/205 |
| 2008/0096398 | A1 * | 4/2008 | Rohrbach | H01R 13/6205 439/39 |

(Continued)

FOREIGN PATENT DOCUMENTS

TW M454008 5/2013

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector assembly includes a first connector and a second connector. The first connector includes a first terminal group and a first magnetic element around the first terminal group, the first terminal group defines a first central terminal and two first outer terminals located at both sides of the first central terminal. The second connector includes a second terminal group and a second magnetic element, the second terminal group defines a second central terminal, a second outer terminal and an elastic terminal located at both sides of the second central terminal. When the first connector is engaging with the second connector, the first and second magnetic elements are attached to each other, the first central terminal is contacting the second central terminal, the second outer terminal is contacting either of the first outer terminals and the elastic terminal is elastically abutting against the first magnetic element.

19 Claims, 8 Drawing Sheets

(56) References Cited

U.S. PATENT DOCUMENTS

2012/0083137 A1* 4/2012 Rohrbach ..... H01R 13/6205 439/39
2012/0148195 A1* 6/2012 Umeno ..... G02B 6/3817 385/53
2013/0065406 A1* 3/2013 Rohrbach ..... H01R 13/6205 439/39
2013/0189855 A1* 7/2013 Lai ..... H01R 11/30 439/39
2013/0260577 A1* 10/2013 Chen ..... H01R 11/30 439/39
2013/0316549 A1* 11/2013 DiFonzo ..... H01R 13/6205 439/39
2013/0323941 A1* 12/2013 Zeliff ..... H01R 13/6205 439/39
2014/0011375 A1* 1/2014 Lin ..... H01R 13/6205 439/39
2014/0024227 A1* 1/2014 Umeno ..... G02B 6/3817 439/39
2014/0087581 A1* 3/2014 Umeno ..... G02B 6/3817 439/374
2015/0194764 A1* 7/2015 Magana ..... H01R 13/6205 439/39

* cited by examiner

DUAL ORIENTATION ELECTRICAL CONNECTOR ASSEMBLY

BACKGROUND OF THE INVENTION

1. Field of the Invention

The present invention relates to an electrical connector assembly, and more particularly to an electrical connector assembly can be engaged in two directions with different number of the terminals.

2. Description of the Related Art

U.S. Pat. No. 7,311,526 issued on Dec. 25, 2007, discloses a magnetic connector including a plug and a receptacle relying on magnetic force to maintain contact. The plug and receptacle each defines at least one magnet and a magnetic element for attracting the magnets, which makes the plug can be combined with the receptacle by magnetic attraction so as to achieve the purpose of power supply. However, the number of terminals of the plug and receptacle must be consistent when the magnetic connector is connected.

Therefore, an improved electrical connector assembly is highly desired to meet overcome the requirement.

BRIEF SUMMARY OF THE INVENTION

An object of the present invention is to provide an electrical connector assembly can be engaged in two directions with different number of the terminals and having a detection function.

In order to achieve above-mentioned object, an electrical connector assembly includes a first connector and a second connector. The first connector includes a first terminal group and a first magnetic element around the first terminal group, the first terminal group defines a first central terminal and two first outer terminals located at both sides of the first central terminal. The second connector includes a second terminal group and a second magnetic element around the second terminal group, the second terminal group defines a second central terminal, a second outer terminal located at a side of the second central terminal and an elastic terminal located at another side of the second central terminal. When the first connector is engaging with the second connector in a first position, the first magnetic element and the second magnetic element are attached to each other in order to maintain the mating between the first and second connector, the first central terminal is contacting the second central terminal, the second outer terminal is contacting one of the first outer terminals and the elastic terminal is elastically abutting against the first magnetic element of the first connector in order to form electrical transmission, when the first connector is engaging with the second connector by rotating 180 degree to a second position, the first central terminal is contacting the second central terminal, the second outer terminal is contacting the other one of the first outer terminals and the elastic terminal is elastically abutting against the first magnetic element of the first connector in order to form electrical transmission.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
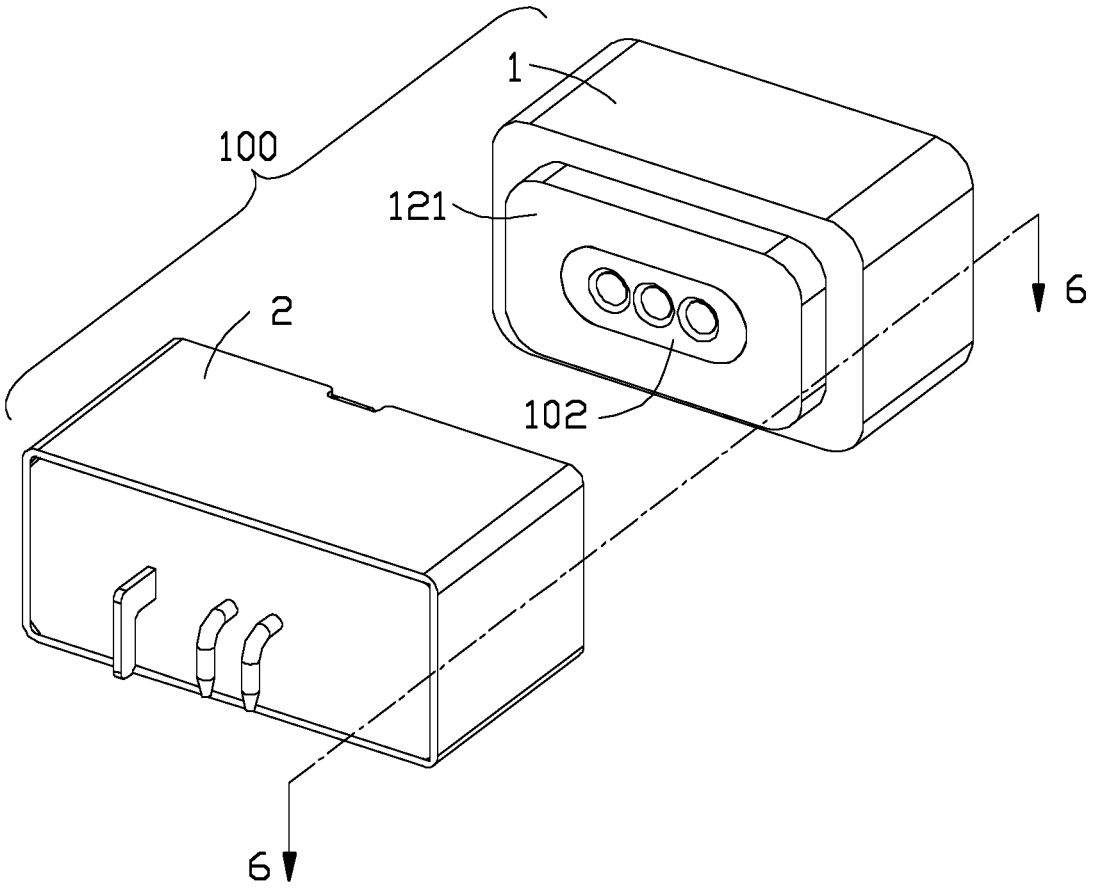
FIG. 1 is a perspective view showing an electrical connector assembly in accordance with the present invention.
Figure 2:
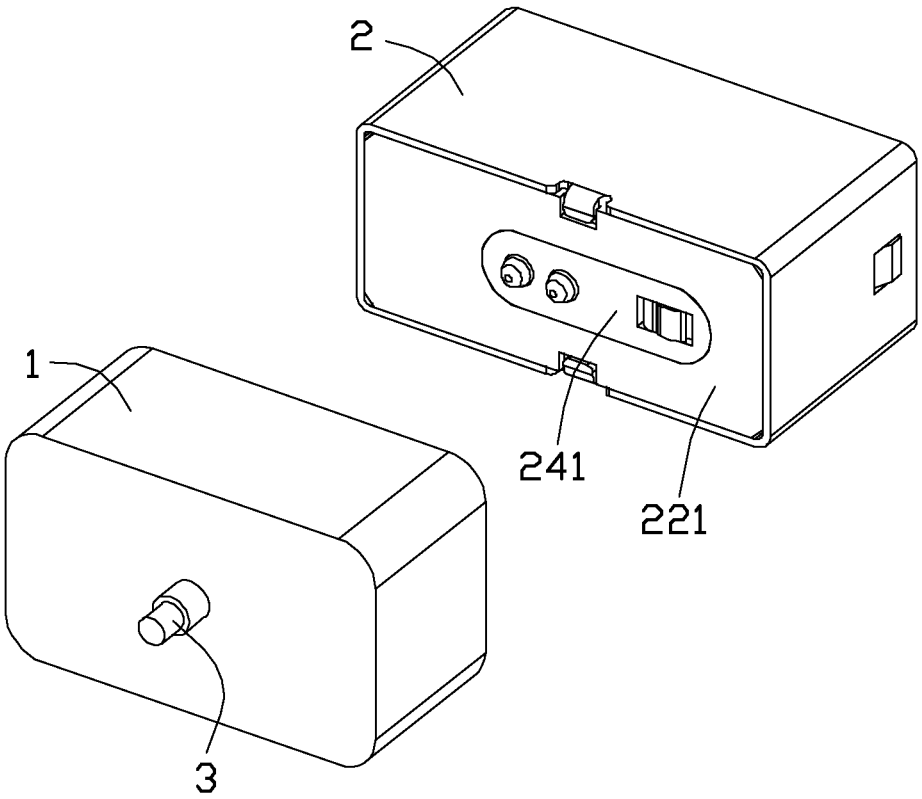
FIG. 2 is another perspective view of the electrical connector assembly shown in FIG. 1.

Reference will now be made to the drawing figures to describe a preferred embodiment of the present invention in detail. Referring to FIG. 1 and FIG. 2, an electrical connector assembly 100 is used to achieve power supply. The electrical connector assembly 100 includes a first connector 1 connected to a cable 3 and a second connector 2 used for mounting on a circuit board, the second connector 2 is usually installed in a device, such as tablet PCs or laptops. The second connector 2 is mounted on the side of the device and retracted within the outside of the device so that a receiving cavity is formed between the housing and the front surface of the second connector, and the receiving cavity is used for exactly the first connector inserted into.

Figure 3:
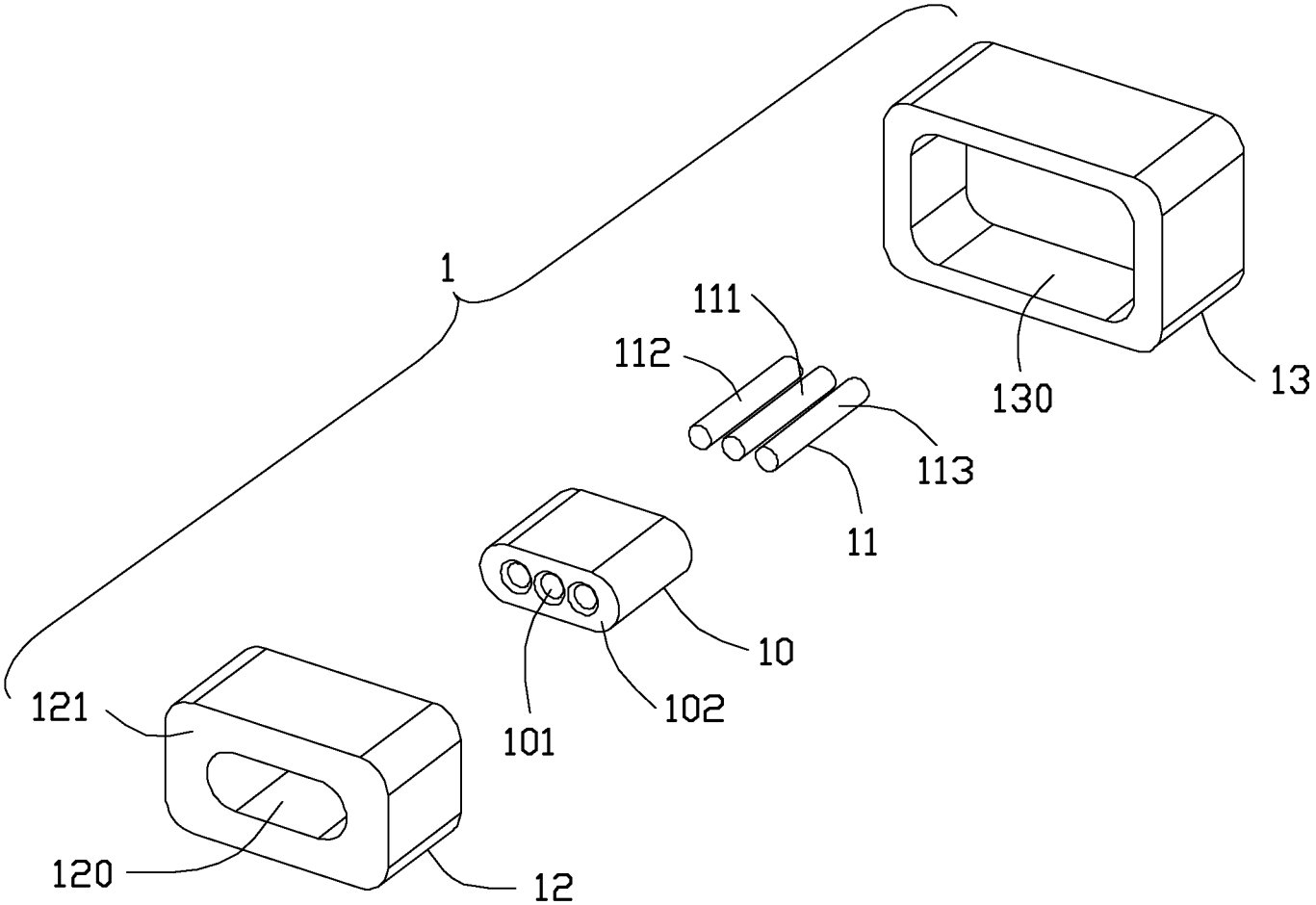
FIG. 3 is an exploded perspective view of a first connector of the electrical connector assembly shown in FIG. 1.

Referring to FIG. 3, the first connector 1 includes a first insulative housing 10, a first terminal group 11 fixed in the first insulative housing 10, a first magnetic element 12 around the first terminal group 11 and a insulative shell 13, the first magnetic element 12 is a ferromagnetic material and substantially rectangular shape. The first insulative housing 10 defines a plurality of first terminal slots 101 receiving the first terminal group 2, the inner surface of the first terminal slot 101 facing to a front surface 102 of the first insulative housing 10 is gradually expanded shape. The first magnetic element 12 defines a receiving cavity 120 running through the front surface 121 and the rear surface thereof, the first insulative housing 10 is tightly fixed in the receiving cavity 120 of the first magnetic element 12.

Figure 6:
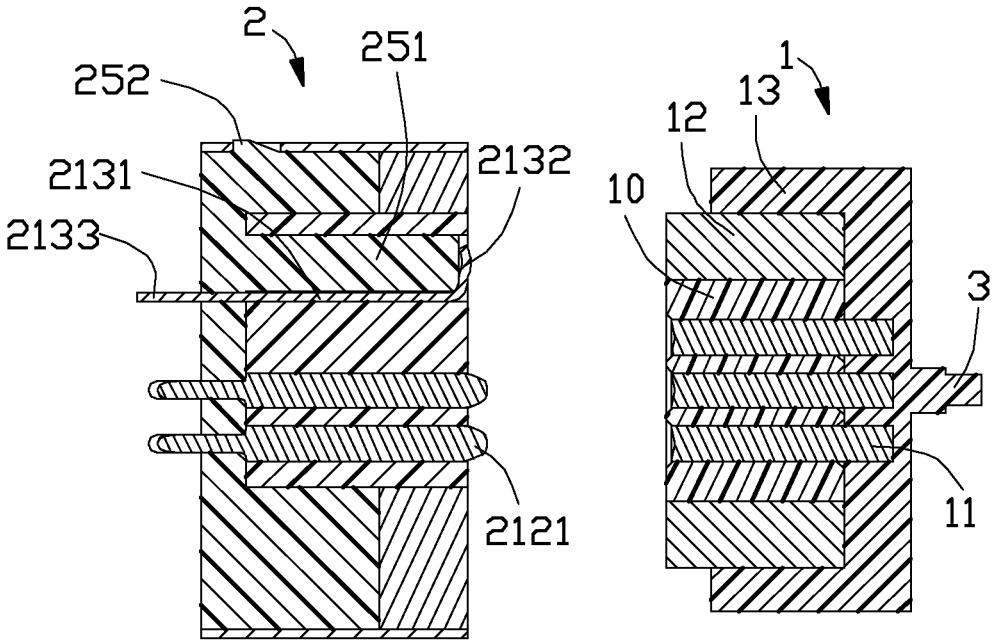
FIG. 6 is a cross-sectional perspective view of the electrical connector assembly take along the line 6-6 shown in FIG. 1.

Referring to FIG. 1 and FIG. 6, the first magnetic element 12 is fixed in a receiving space 130 of the insulative shell 13 and the front surface 121 of the first magnetic element 12 is exposed outside of the insulative shell 13 to form a mating surface of the first connector. The front portion of the first magnetic element 12 is projecting forwardly from the front surface of the insultive shell 13, the mating surface is located in front of the front surface of the insultive shell 13 and the front surface 102 of the first insulative housing 10 is flush with the mating surface. In the preferred embodiment, the first terminal group 11 of the first connector 1 defines a first central terminal 111 and two first outer terminals 112, 113 located at both sides of the first central terminal 111, the first central terminal 111 and the first outer terminals 112, 113 are telescopic in the first terminal slots 101 along a front-to-rear direction, and the distance from the first central terminal 111 to the first outer terminals 112 is equal to the distance from the first central terminal 111 to the first outer terminals 113. In a free state, the front end of the first terminal group 11 is substantially flush with the mating surface, and the front end of the first terminal group 11 can be retracted into the inside of the first terminal slots 101 by actuated. The first terminal group 11 defines a plurality of connecting portions in the rear side thereof, the connecting portions are projecting rearwardly outside of the first insulative housing 10 and connecting to the conductive core wires of the cable 3.

Figure 4:
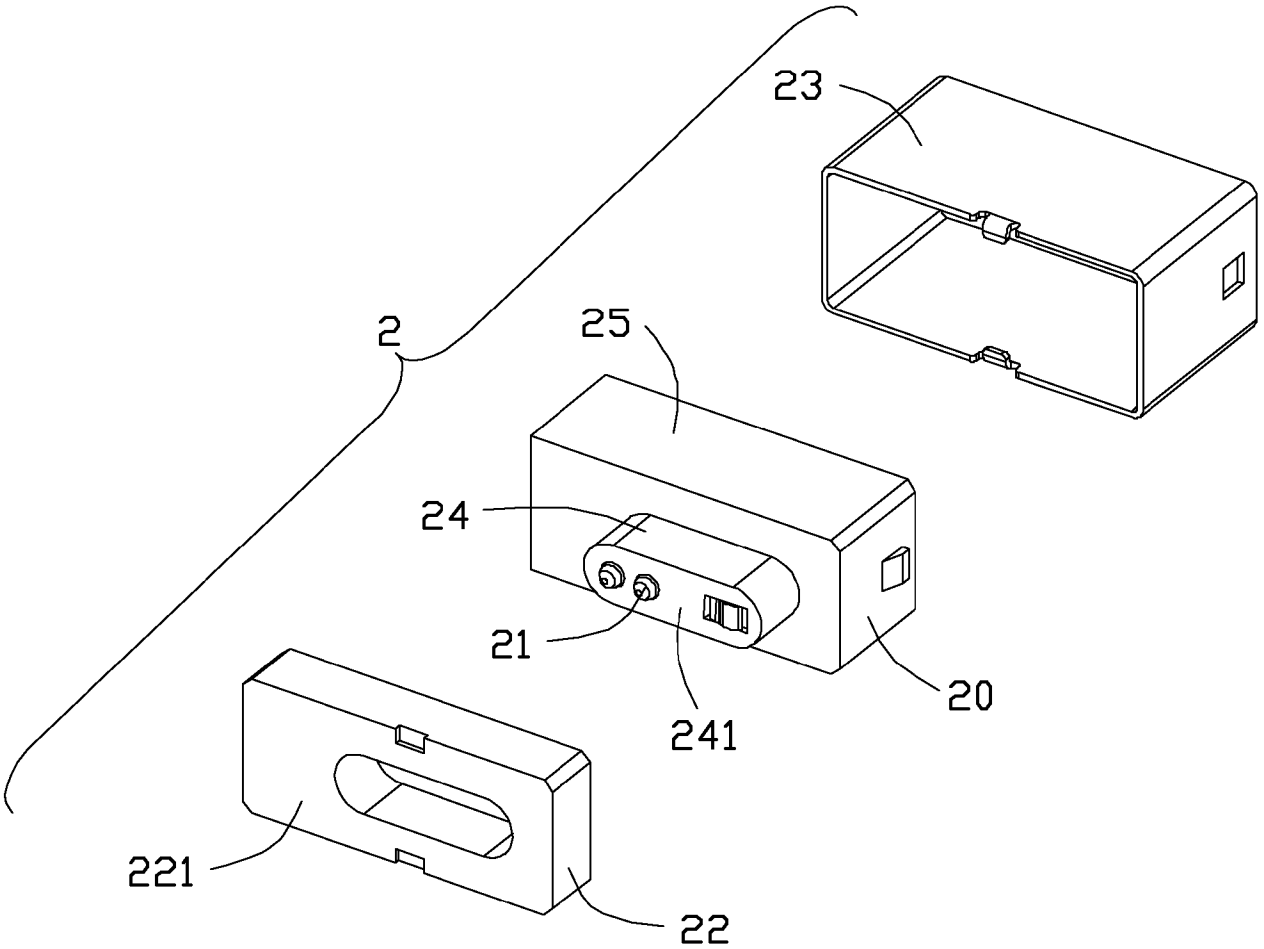
FIG. 4 is a partly exploded perspective view of a second connector of the electrical connector assembly shown in FIG. 1.
Figure 5:
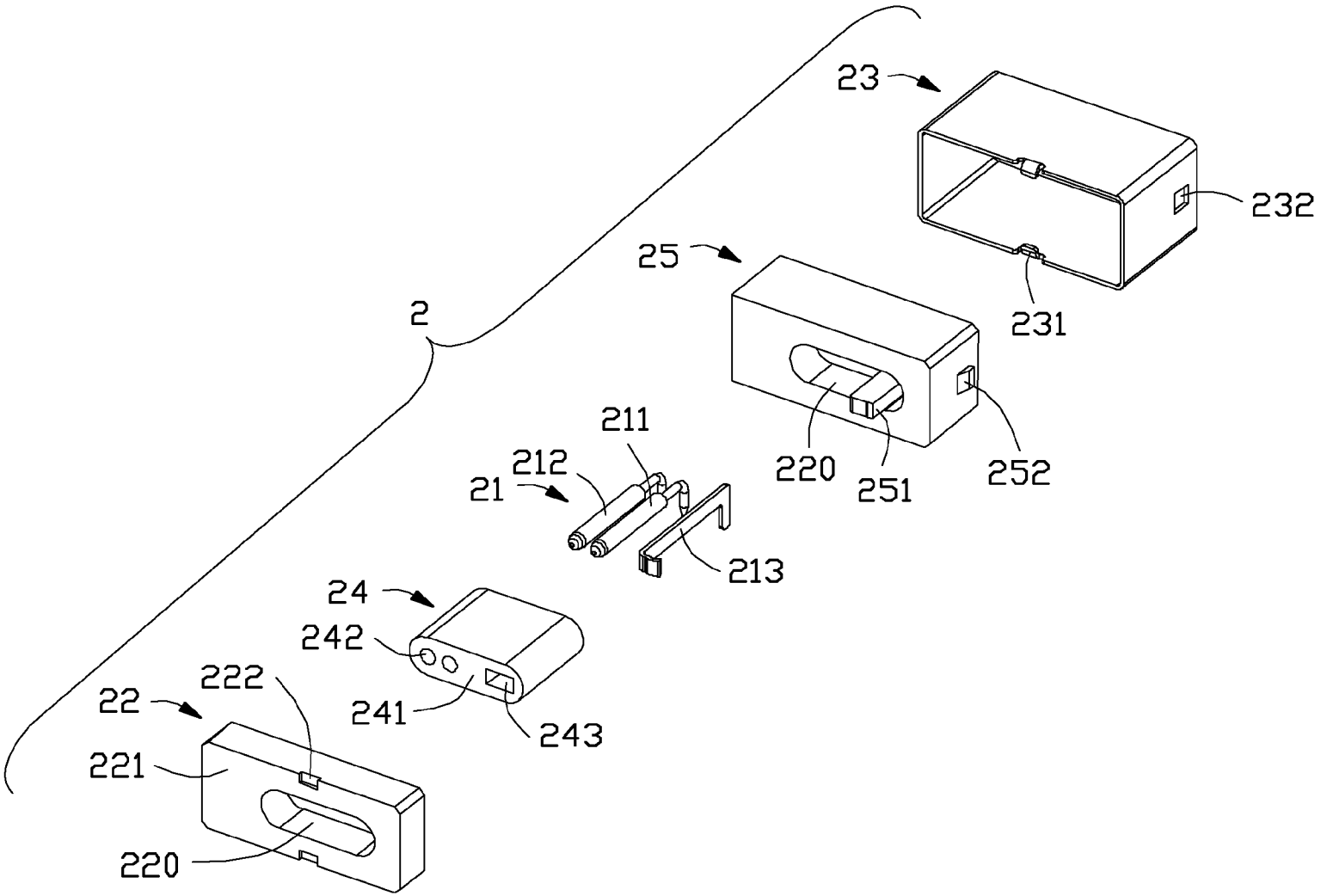
FIG. 5 is an exploded perspective view of a second connector of the electrical connector assembly shown in FIG. 1.

Referring to FIG. 4 to FIG. 6, the second connector 2 includes a base 20, a second terminal group 21 fixed in the base 20, a second magnetic element 22 around the second terminal group 21 and a metal shell 23, the second magnetic element 22 is a magnet and substantially rectangular shape. The base 20 defines a base portion 25 and a second insulative housing 24 projecting outside of the bade portion 25, the base portion 25 and the second magnetic element 22 together form a receiving cavity 220 for receiving the second insulative housing 24, the second insulative housing 24 defines a plurality of second terminal slots 242 and a terminals slot 243 for receiving the second terminal group 22. In the preferred embodiment, the second terminal group 21 defines a second central terminal 211, a second outer terminal 212 located at a side of the second central terminal 211 and an elastic terminal 213 located at the other side of the second central terminal 211. The second central terminal 211 and the second outer terminal 212 are non-scalable terminals receiving in the second terminal slots 242 and each defines a contacting portion 2121 projecting outside of the front surface 241 of the second insulative housing 24.

Referring to FIG. 2 to FIG. 6, the base 20 abuts the rear surface of the second magnetic element 22, the second insulative housing 24 is tightly secured in the receiving cavity 220, and the front surface 241 of the second insulative housing 24 and the front surface 221 of the second magnetic element 22 together form a mating surface of the second connector 2. The base portion 25 defines a post 251 projecting into the terminal slot 243. The elastic terminal 213 defines a retaining portion 2131 adjust to the post 251 and fixed to the terminal slot 243, an elastic contacting arm 2132 bending from the retaining portion 2131 and abutting the front surface of the post 25 and a soldering portion 2133 extending outside of the base 20. The metal shell 23 surrounds the outside of the base portion 25 and the second magnetic element 22. The second magnetic element 22 defines two recesses 222 in both sides of the front surface 221 thereof in a vertical direction and the metal shell 23 defines a pair of locking pieces 231 attached to the corresponding recesses 222, the metal shell 23 defines a pair of locking holes 232 in both sides thereof in a longitudinal direction and the base portion 25 defines a pair of locking portions 252 projecting outwardly and clasping the corresponding locking holes 232, thereby the metal shell is fixed.

Figure 7:
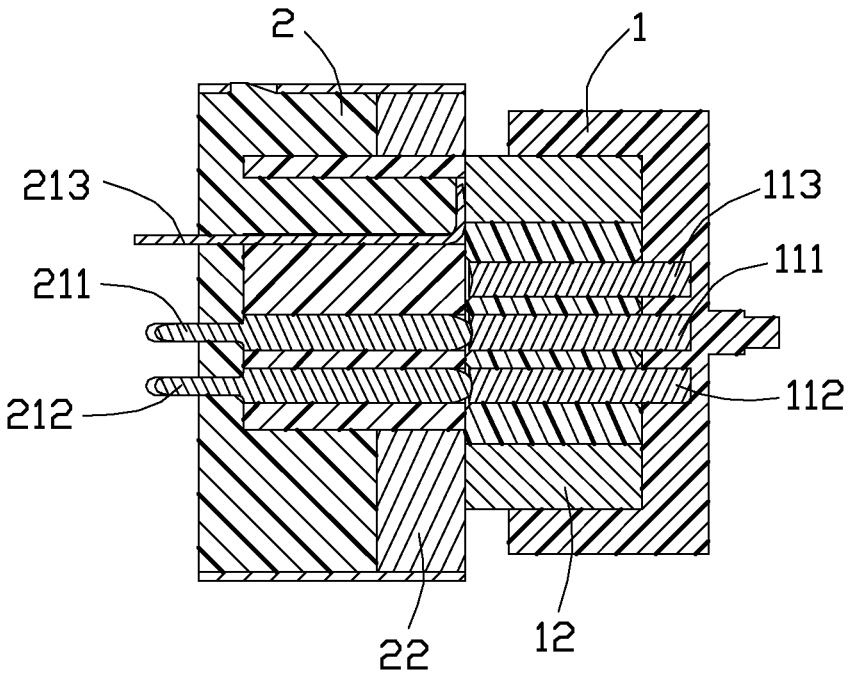
FIG. 7 is a cross-sectional perspective view of the electrical connector assembly take along the line 6-6 shown in FIG. 1, wherein the electrical connector assembly is connected.
Figure 8:
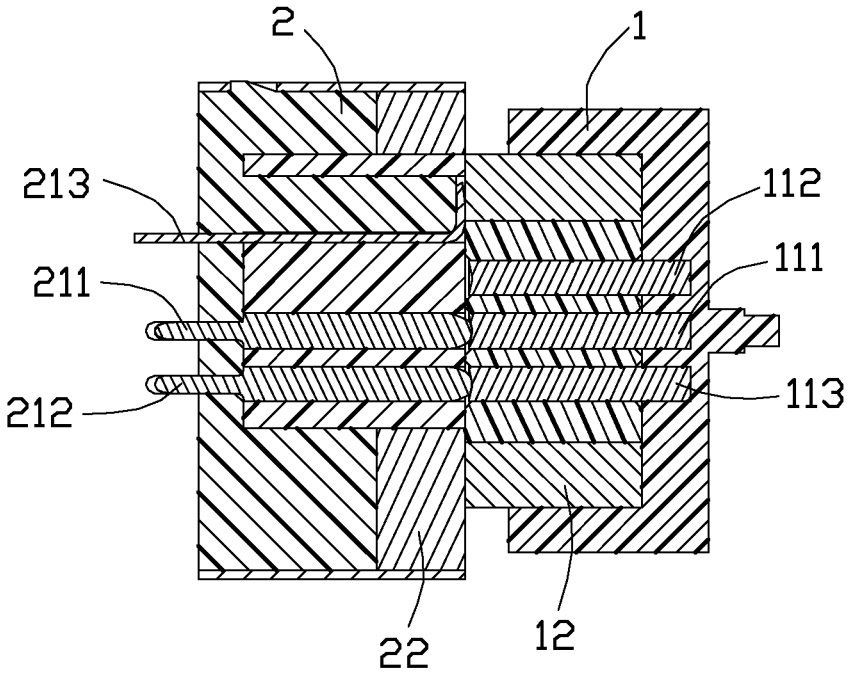
FIG. 8 is a cross-sectional perspective view of the electrical connector assembly take along the line 6-6 shown in FIG. 1, wherein the first connector is connected with the second connector by rotating 180 degrees.

Referring to FIG. 7 to FIG. 8, when the first connector 1 is engaging with the second connector 2 in a first position, the first magnetic element 12 and the second magnetic element 22 are attached to each other in order to maintain the mating between the first and second connector, the first central terminal 111 is contacting the second central terminal 211, the second outer terminal 212 is contacting the first outer terminal 112 and the elastic terminal 213 is elastically abutting against the first magnetic element 12 of the first connector 1 in order to form electrical transmission. When the first connector 1 is engaging with the second connector 2 by rotating 180 degree to a second position, the first central terminal 111 is contacting the second central terminal 211, the second outer terminal 212 is contacting another first outer terminal 113 and the elastic terminal 213 is elastically abutting against the first magnetic element 12 of the first connector 1 in order to form electrical transmission, which ensures the electrical connector assembly engaged in two directions. Wherein the first central terminal 111 is connecting the second central contact for transmitting a first power supply signal, the second outer terminal 212 is respectively connecting the first outer terminals 112, 113 for transmitting a second power supply signal, and the elastic terminal 213 is elastically abutting the first magnetic element 12 of the first connector for transmission detection signal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector assembly, comprising:

a first connector including a first terminal group and a first magnetic element around the first terminal group, the first terminal group defining a first central terminal and two first outer terminals located at both sides of the first central terminal;

a second connector including a second terminal group and a second magnetic element around the second terminal group, the second terminal group defining a second central terminal, a second outer terminal located at a side of the second central terminal and an elastic terminal located at another side of the second central terminal; wherein when the first connector is engaging with the second connector in a first position, the first magnetic element and the second magnetic element are attached to each other in order to maintain the mating between the first and second connector, the first central terminal is contacting the second central terminal, the second outer terminal is contacting one of the first outer terminals and the elastic terminal is elastically abutting against the first magnetic element of the first connector in order to form electrical transmission, when the first connector is engaging with the second connector by rotating 180 degree to a second position, the first central terminal is contacting the second central terminal, the second outer terminal is contacting the other one of the first outer terminals and the elastic terminal is elastically abutting against the first magnetic element of the first connector in order to form electrical transmission; wherein the second connector includes a base abutting against the rear side of the second magnetic element and receiving the second terminal group, the front surfaces of the base and the second magnetic element together form a mating surface of the second connector; wherein the base defines a base portion and a second insulative housing projecting outside of the base portion, the base portion and the second magnetic element together form a receiving cavity for receiving the second insulative housing, and the second terminal group is retained in the second insulative housing.

2. The electrical connector assembly as described in claim 1, wherein the first central terminal is connecting the second central terminal for transmitting a first power supply signal, the second outer terminal is respectively connecting the first outer terminals for transmitting a second power supply signal, and the elastic terminal is elastically abutting the first magnetic element of the first connector for transmission detection signal.

3. The electrical connector assembly as described in claim 1, wherein the first connector includes a first insulative housing and an insulative shell, the first magnetic element is fixed in the insulative shell and the front surface of the first magnetic element is exposed outside of the insulative shell to form a mating surface of the first connector, the first insulative housing is retained in the first magnetic element and defines a plurality of first terminal slots for receiving the first terminal group.

4. The electrical connector assembly as described in claim 3, wherein the inner surface of the first terminal slot facing to the front surface of the first insulative housing is gradually expanded shape, the front portion of the first magnetic element is projecting forwardly from the front surface of the insulative shell, and the mating surface is located at front of the front surface of the insulative shell and the front surface of the first insulative housing is flush with the mating surface.

5. The electrical connector assembly as described in claim 3, wherein the first central terminal and the first outer terminals are scalable terminals and telescopic in the first terminal slots along a front-to-rear direction, and the distance from the first central terminal to either of the first outer terminals are equal.

6. The electrical connector assembly as described in claim 1, wherein the second insulative housing defines a plurality of terminal second slots and a terminal slot, the base portion defines a post projecting into the terminal slot, the elastic terminal defines a retaining portion adjust to the post and fixed to the terminal slot, an elastic contacting arm bending from the retaining portion and abutting the front surface of the post and a soldering portion extending outside of the base.

7. The electrical connector assembly as described in claim 6, wherein the second central terminal and the second outer terminal are non-scalable terminals receiving in the second terminal slots and each defines a contacting portion projecting outside of the front surface of the second insulative housing.

8. The electrical connector assembly as described in claim 1, wherein the second connector includes a metal shell surrounds the outside of the base portion and the second magnetic element, the second magnetic element defines two recesses in both sides of the front surface thereof in a vertical direction and the metal shell defines a pair of locking pieces attached to the corresponding recesses, the metal shell defines a pair of locking holes in both sides thereof in a longitudinal direction and the base portion defines a pair of locking portions projecting outwardly and clasping the corresponding locking holes.

9. An electrical connector assembly comprising:

a first connector including a first insulative housing enclosing therein a plurality of first terminals in one row along a transverse direction, each of said first terminals essentially extending along a front-to-back direction perpendicular to said transverse direction, a first magnetic element surrounding the first insulative housing, the first insulative housing defining a first electrical mating face, and the first magnetic element defining a first magnetic mating face;

a second connector including a second insulative housing enclosing therein a plurality of second terminals in one row along said transverse direction, each of said second terminals extending along the front-to-back direction, a second magnetic element surrounding the second insulative housing, the second insulative housing defining a second electrical mating face, and the second magnetic element defining a second magnetic mating face;

said first terminals being arranged in a symmetrical manner with regard to a first front-to-back centerline of the first connector, the second terminals including at least one power terminal and one detect terminal arranged asymmetrically with regard to a second front-to-back centerline of the second connector, wherein during mating in either orientation, the first magnetic element and the second magnetic element are coupled to each other, the power terminal of the second connector is electrically and mechanically connected to the corresponding first terminal of the first connector for power transmission, and the detect terminal of the second connector is electrically and mechanically connected to the first magnetic element for detection transmission; wherein the first connector includes three first terminals with thereof one located in the first front-to-back centerline, while the second connector includes two power terminals with thereof one located in the second front-to-back centerline for mating with the corresponding terminal of the first connector located in the first front-to-back centerline.

10. The electrical connector assembly as claimed in claim 9, wherein the first electrical mating face is coplanar with the first magnetic mating face, and the second electrical mating face is essentially parallel and coplanar with the second magnetic mating face.

11. The electrical connector assembly as claimed in claim 9, wherein the first magnetic element is symmetrically arranged with regard to the first insulative housing in said transverse direction while the second magnetic element is asymmetrically arranged with regard to the second insulative housing to comply with the detect contact of the second connector in said transverse direction.

12. The electrical connector assembly as claimed in claim 9, wherein the first insulative housing is symmetrically arranged with regard to the first magnetic element in said transverse direction while the second insulative housing is asymmetrically arranged with regard to the second magnetic element in said transverse direction.

13. The electrical connector assembly as claimed in claim 9, wherein both the power terminal and the detect terminal of the second connector are deformable in the front-to-back direction.

14. The electrical connector assembly as claimed in claim 9, wherein the first connector further includes a first insulative shell enclosing the first magnetic element, and the second connector further includes a second insulative base enclosing the second insulative housing and located behind the second magnetic element in the front-to-back direction.

15. The electrical connector as claimed in claim 9, wherein the detect terminal and the other one power terminal are respectively asymmetrically located by two sides of said one power terminal in the second front-to-back centerline.

16. The electrical connector as claimed in claim 15, wherein said detect terminal is transversely farther from said one power terminal in the second front-to-back centerline than the other power terminal from said one power terminal in the second front-to-back centerline.

17. An electrical connector comprising:

an insulative housing defining a plurality of first terminal slots and at least one second terminal slot all arranged in one row in a transverse direction and each extending therethrough in a front-to-back direction perpendicular to said transverse direction;

a plurality of power terminals disposed in the corresponding first terminal slots, respectively;

at least one detect terminal disposed in the corresponding second terminal slot;

a magnetic element surrounding said insulative housing; and one of said first terminal slots and the corresponding power terminal being located in a centerline of the whole connector while the insulative housing being asymmetrically arranged with regard to the magnetic element whereby during mating with a complementary connector in either orientation, power transmission can be made by the power terminals and corresponding power terminals of the complementary connector, and detection can be made by the detect terminal and a magnetic element of the complementary connector.

18. The electrical connector as claimed in claim 17, wherein said housing defines a electrical mating face beyond which the power terminals extend, and said magnetic element defines a magnetic mating face which is parallel and coplanar with the electrical mating face.

19. The electrical connector as claimed in claim 17, wherein the power terminals are formed to be different from the detect terminal in both configuration and deformation.

* * * * *